US010184368B2

(12) United States Patent
Takada et al.

(10) Patent No.: US 10,184,368 B2
(45) Date of Patent: Jan. 22, 2019

(54) BREATHER DEVICE FOR INTERNAL COMBUSTION ENGINE

(71) Applicant: HONDA MOTOR CO., LTD., Tokyo (JP)

(72) Inventors: Hideaki Takada, Wako (JP); Daiki Kamiyama, Wako (JP); Masanori Ooae, Wako (JP); Yoshinobu Kondo, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 55 days.

(21) Appl. No.: 15/172,678

(22) Filed: Jun. 3, 2016

(65) Prior Publication Data

US 2017/0002704 A1 Jan. 5, 2017

(30) Foreign Application Priority Data

Jun. 30, 2015 (JP) ..... 2015-131321

(51) Int. Cl.
*F01M 13/04* (2006.01)
*F01M 13/00* (2006.01)

(52) U.S. Cl.
CPC ..... *F01M 13/0011* (2013.01); *F01M 13/04* (2013.01); *F01M 2013/0022* (2013.01);
(Continued)

(58) Field of Classification Search
CPC ..... F01M 13/04; F01M 2013/0438; F01M 2013/0422; F01M 13/0011; F01M 13/023;
(Continued)

(56) References Cited

U.S. PATENT DOCUMENTS 2,693,789 A * 11/1954 Lechtenberg ..... F01P 1/02 123/195 R
3,250,263 A * 5/1966 Gerjets ..... F01M 13/04 123/573
(Continued)

FOREIGN PATENT DOCUMENTS

GB 1195470 A * 6/1970 ..... F01M 13/04
JP 6271321 U 5/1987
(Continued)

OTHER PUBLICATIONS

Japanese Office Action for Application No. 2015-131321, dated Jul. 5, 2016, 6 pages.
(Continued)

*Primary Examiner* — Grant Moubry
*Assistant Examiner* — Tea Holbrook
(74) *Attorney, Agent, or Firm* — Armstrong Teasdale LLP

(57) ABSTRACT

In a breather device for an internal combustion engine for guiding blow-by gas generated in a crank chamber to an intake system, the breather device includes: a breather chamber formed adjacent to the crank chamber such that the breather chamber communicates with the crank chamber, the breather chamber being configured to separate oil from the blow-by gas that flows in the breather chamber from the crank chamber; a filter chamber formed adjacent to the crank chamber such that the filter chamber communicates with the breather chamber, the filter chamber accommodating a filter for separating oil from the blow-by gas that flows in the filter chamber from the breather chamber; and a breather passage that communicates the filter chamber and the intake system with each other.

16 Claims, 4 Drawing Sheets

(52) U.S. Cl.
CPC ..... *F01M 2013/0038* (2013.01); *F01M 2013/0044* (2013.01); *F01M 2013/0438* (2013.01); *F01M 2013/0494* (2013.01)

(58) Field of Classification Search
CPC ..... F01M 13/00; F01M 2013/0433; F01M 2013/0427; F01M 13/028; F01M 1/04; F01M 2013/0038; F01M 2013/0083; F01M 2013/0494; F01M 11/04; F01M 2001/1085; F01M 2001/1092; F01M 2013/0461; B01D 46/0031; B01D 46/003; B01D 46/2411; B01D 46/0023
USPC ..... 123/572–574, 41.86
See application file for complete search history.

(56) References Cited

U.S. PATENT DOCUMENTS 3,277,876 A * 10/1966 Abts ..... F01M 13/022 123/572
3,290,869 A * 12/1966 Lentz ..... F01M 13/022 137/533
3,450,117 A * 6/1969 Greening ..... F02M 35/08 123/572
3,589,347 A * 6/1971 Sawada ..... C21C 5/30 123/572
4,404,936 A * 9/1983 Tatebe ..... F01M 13/00 123/196 R
4,502,424 A * 3/1985 Katoh ..... F01M 5/00 123/196 R
4,549,520 A * 10/1985 Tamba ..... F01M 13/0011 123/572
4,607,604 A * 8/1986 Kanoh ..... F01M 13/0416 123/572
4,653,457 A * 3/1987 Stege ..... F01M 13/0033 123/572
4,856,486 A * 8/1989 Mori ..... F01M 13/025 123/192.2
4,861,359 A * 8/1989 Tettman ..... B01D 46/0031 123/198 E
4,881,510 A * 11/1989 Etoh ..... F01M 9/10 123/196 W
5,474,035 A * 12/1995 Ming ..... F01M 13/023 123/41.86
5,794,602 A * 8/1998 Kimura ..... F01M 13/04 123/572
6,247,463 B1 * 6/2001 Fedorowicz ..... F01M 13/0416 123/572
6,422,224 B1 * 7/2002 Walker, Jr. ..... F01M 13/04 123/572
8,146,574 B2 * 4/2012 Heckel ..... F02M 25/06 123/198 E
2001/0054418 A1 * 12/2001 Burgess ..... F01M 13/023 123/572
2002/0046743 A1 * 4/2002 Moren ..... F01M 13/022 123/572
2003/0089352 A1 * 5/2003 Yoneyama ..... F01M 13/04 123/572
2004/0173193 A1 * 9/2004 Burgess ..... B01D 46/0031 123/573
2007/0056571 A1 * 3/2007 Nelson ..... F01M 13/04 123/572
2007/0095335 A1 * 5/2007 Matsuda ..... F01M 13/021 123/572
2008/0216794 A1 * 9/2008 Kuji ..... F02D 9/106 123/336
2009/0071752 A1 * 3/2009 Raasch ..... F01M 11/04 184/1.5
2009/0301446 A1 * 12/2009 Asanuma ..... F01M 13/028 123/559.1
2009/0314230 A1 * 12/2009 Nagenkogl ..... F01M 13/04 123/41.44
2014/0109885 A1 * 4/2014 Kalayci ..... F01M 13/0011 123/572
2015/0114368 A1 * 4/2015 Kurita ..... F01M 13/04 123/573
2015/0159596 A1 * 6/2015 Wakiya ..... F01M 13/00 123/41.86

FOREIGN PATENT DOCUMENTS

JP 6325161 U 2/1988
JP 0842400 A 2/1996
JP 09250325 A 9/1997
JP 2005180360 A 7/2006
JP 2006200472 A 8/2006
JP 2011064080 A 3/2011
JP 2014183654 A 9/2014
JP WO 2016039143 A1 * 3/2016 ..... F02F 7/00
WO WO 2014028729 A1 * 2/2014 ..... F02M 25/06

OTHER PUBLICATIONS

Japanese Office Action issued in Japanese Application No. 2016-129836, dated Apr. 24, 2018.

* cited by examiner

BREATHER DEVICE FOR INTERNAL COMBUSTION ENGINE

TECHNICAL FIELD

The present invention relates to a breather device for an internal combustion engine, the breather device being provided with a filter for separating oil from blow-by gas.

BACKGROUND OF THE INVENTION

In four-cycle engines, blow-by gas, which is a gas that leaked from the combustion chamber through a gap between the cylinder wall and the piston, is generated in the crank chamber, and to send the blow-by gas back to the combustion chamber, a breather device for guiding the blow-by gas to the intake system is provided. The blow-by gas contains oil mist, and if the oil is mixed into the intake air, the emission will be deteriorated. Therefore, a breather chamber that communicates with the crank chamber is provided integrally with the crankcase to separate the oil mist from the blow-by gas at the breather chamber, whereby the mixture of oil into the intake air is prevented (see JP2006-200472A, for example).

However, in some cases, merely providing the breather chamber may not achieve sufficient oil separation. In such cases, it may be conceived to provide a filter device for oil separation in a part of a breather passage that connects the breather chamber with the intake system. However, in such an arrangement, in a cold state operation such as when the engine is started in a low temperature environment or when the engine is operated in a frigid environment, the viscosity of the oil is increased due to the low temperature and hence the oil tends to adhere to and clog the filter. To solve such a problem, it may be conceived to wrap the filter device and/or the pipe forming a part of the breather passage extending from the breather chamber to the filter device with thermal insulation material, to thereby suppress dissipation of heat that these members have absorbed from the blow-by gas. However, such an arrangement would increase the amount of material used and the number of assembly steps, and in addition, would increase the size of the breather device.

SUMMARY OF THE INVENTION

In view of such prior art problems, a primary object of the present invention is to provide a breather device for an internal combustion engine such that, even in a cold state operation, the breather device can effectively separate oil from the blow-by gas guided to the intake system.

To achieve such an object, in accordance with one aspect of the present invention, there is provided a breather device for an internal combustion engine for guiding blow-by gas generated in a crank chamber to an intake system, the breather device including: a breather chamber formed adjacent to the crank chamber such that the breather chamber communicates with the crank chamber, the breather chamber being configured to separate oil from the blow-by gas that flows in the breather chamber from the crank chamber; a filter chamber formed adjacent to the crank chamber such that the filter chamber communicates with the breather chamber, the filter chamber accommodating a filter for separating oil from the blow-by gas that flows in the filter chamber from the breather chamber; and a breather passage that communicates the filter chamber and the intake system with each other. Preferably, a wall defining the breather chamber and a filter housing defining the filter chamber are both integral with a crankcase defining the crank chamber.

In the breather device having such a structure, because the filter chamber accommodating the filter is provided in addition to the breather chamber, it is possible to separate oil from blow-by gas effectively. Further, because both the breather chamber and the filter chamber are formed adjacent to the crank chamber and are warmed by the heat from the crank chamber, a decrease in the temperature of the blow-by gas flowing therethrough and the oil contained in the blow-by gas is suppressed and clogging of the filter by the oil is prevented. Thus, even in a cold state operation, it is possible to effectively separate the oil from the blow-by gas guided to the intake system.

Preferably, the intake system includes an air cleaner having a dust chamber and a clean chamber separated by an air filter, and the breather passage is connected to the dust chamber of the air cleaner.

As described above, in the breather device according to the aspect of the present invention, the oil is separated from the blow-by gas effectively, and this makes it possible to connect the breather passage to the dust chamber of the air cleaner. In this arrangement, the blow-by gas is supplied to the internal combustion engine after passing through the air filter of the air cleaner, and therefore, the oil that could not be separated from the blow-by gas by the filter of the breather chamber can be separated by the air filter of the air cleaner.

Further preferably, the filter chamber is disposed at a position higher than that of the breather chamber.

In this arrangement, because the filter chamber is disposed at a position higher than that of the breather chamber and thus can be warmed easily, absorption of heat from the blow-by gas and oil by the filter can be suppressed, and clogging of the openings of the filter can be prevented even more effectively.

In such an arrangement, the breather device may further include: an oil return passage communicating the filter chamber and the breather chamber with each other; and a one-way valve that is provided to the oil return passage and enables only a flow of a fluid from the filter chamber to the breather chamber.

In this arrangement, the oil separated by the filter chamber disposed at an upper position can be returned easily to the breather chamber disposed at a lower position through the oil return passage owing to the force of gravity. Further, because the oil return passage is equipped with a one-way valve, the oil can be returned to the breather chamber smoothly, without a reverse flow of the oil through the oil return passage to the filter chamber which otherwise could occur due to pressure pulsation in the crank chamber.

Alternatively, the breather device may include an oil return passage communicating the filter chamber and the crank chamber with each other; and a one-way valve that is provided to the oil return passage and enables only a flow of a fluid from the filter chamber to the crank chamber.

In this arrangement, the oil separated by the filter chamber disposed at an upper position can be returned easily to the crank chamber disposed at a lower position through the oil return passage owing to the force of gravity. Further, because the oil return passage is equipped with a one-way valve, the oil can be returned to the crank chamber smoothly, without a reverse flow of the oil through the oil return passage to the filter chamber which otherwise could occur due to pressure pulsation in the crank chamber.

The breather device having the above structure may be preferably disposed in a housing of a cogeneration unit.

In comparison to the case where the internal combustion engine is used as a power source for a vehicle or an outdoor work machine, the internal combustion engine used in a cogeneration unit is required to have a higher emission reduction performance. As the above-described breather device can separate the oil in the blow-by gas effectively and thereby reduce the pollutants in the exhaust gas, the breather device can be preferably used in the cogeneration unit.

Thus, according to the aspect of the present invention, it is possible to provide a breather device for an internal combustion engine such that, even in a cold state operation, the breather device can effectively separate oil from the blow-by gas guided to the intake system.

DETAILED DESCRIPTION OF THE PREFERRED EMBODIMENTS

In the following, embodiments of the present invention will be described in detail with reference to the drawings.

Figure 1:
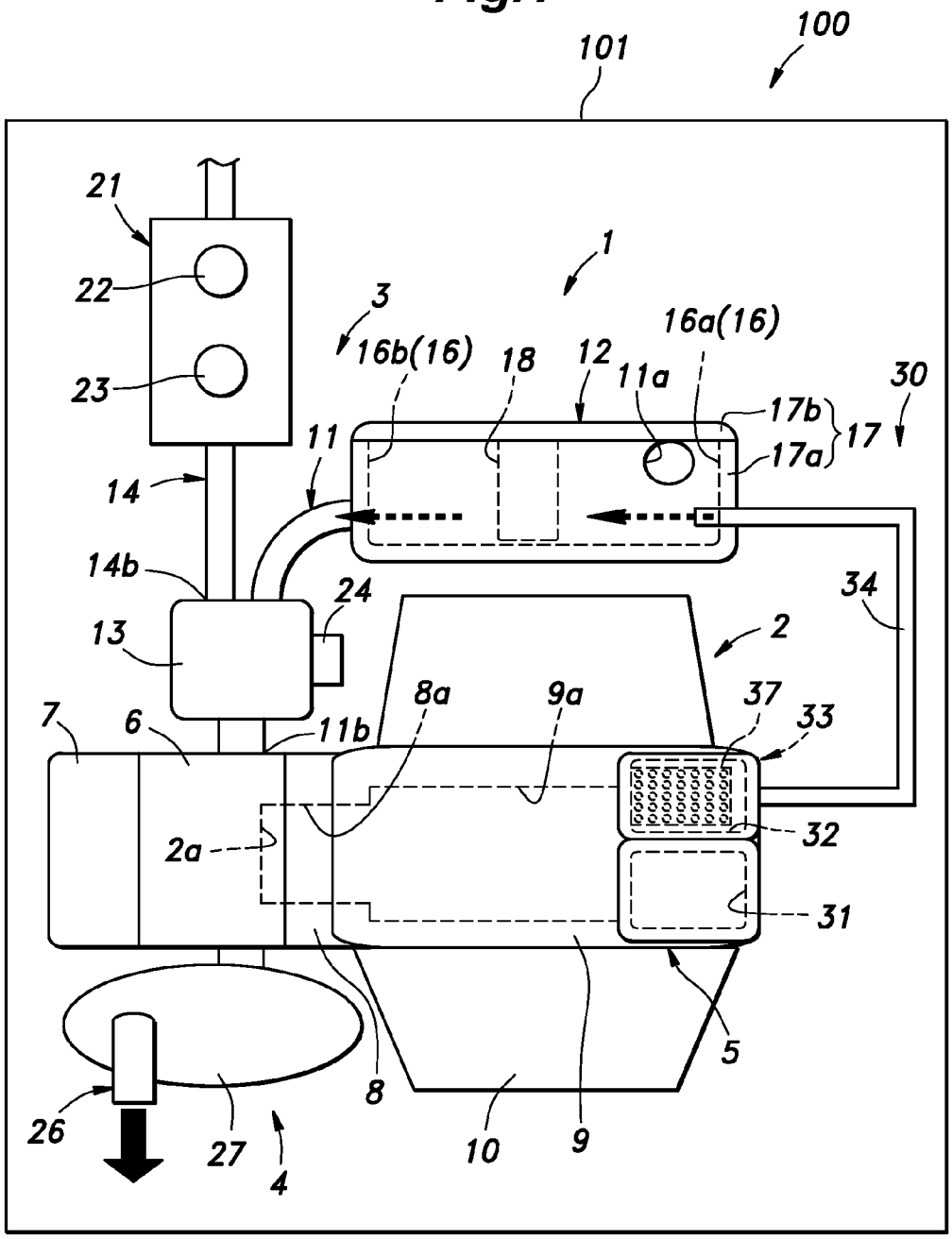
FIG. 1 is a side view schematically showing the structure of a cogeneration unit according to an embodiment of the present invention.

FIG. 1 is a side view schematically showing the structure of a cogeneration unit 100 including a breather device 30 for an internal combustion engine 1 according to an embodiment of the present invention. The cogeneration unit 100 is a unit for providing heat and power, and in the illustrated embodiment, includes a cogeneration case 101, an internal combustion engine 1 disposed in the cogeneration case 101, a generator (not shown in the drawing) driven by the internal combustion engine 1, an exhaust heat exchanger (not shown in the drawing) that uses the exhaust heat of the internal combustion engine 1 as a heat source, and an inverter not shown in the drawing. The internal combustion engine 1 is a four-cycle, single-cylinder, spark-ignition gas engine that uses city gas (or LP gas, LB gas, etc. Simply referred to as "gas" hereinafter) as fuel.

The internal combustion engine 1 includes an engine main body 2 having a combustion chamber 2*a*, an intake system 3 that supplies the engine main body 2 with air-fuel mixture constituted of fuel gas and air, and an exhaust system 4 that guides the exhaust gas discharged from the engine main body 2. The engine main body 2 is disposed such that the cylinder axis extends horizontally, and is provided with an engine block 5 that accommodates a piston, a crankshaft and a connecting rod that connects the piston and the crankshaft (the piston, crankshaft and connecting rod being not shown in the drawing), a cylinder head 6 attached to one end of the engine block 5 on the side of the combustion chamber 2*a*, and a cylinder head cover 7 attached to an end of the cylinder head 6 opposite to the engine block 5. In the illustrated example, the engine block 5 is disposed in such an orientation that the crankshaft extends vertically, but the engine block 5 may be disposed such that the crankshaft extends horizontally. The engine block 5 is constituted of a cylinder block 8 defining a cylinder 8*a* and a crankcase 9 defining a crank chamber 9*a*. An oil pan 10 is attached to an underside of the crankcase 9.

The intake system 3 includes an air intake passage 11 which has an upstream end 11*a* opening out inside the cogeneration case 101 and a downstream end 11*b* connected to the combustion chamber 2*a* via an air intake port formed in the cylinder head 6, an air cleaner 12 provided at an upstream portion of the air intake passage 11, a gas mixer 13 provided at a part of the air intake passage 11 downstream of the air cleaner 12, and a fuel supply passage 14 which has an upstream end connected to a fuel supply source not shown in the drawing and a downstream end 14*b* connected to the gas mixer 13. The gas mixer 13 mixes the fresh air supplied through the air intake passage 11 and the fuel gas supplied through the fuel supply passage 14.

The air cleaner 12 includes an air cleaner case 17 having a box-like shape and internally defining a filter room 16, and an air filter 18 disposed inside the air cleaner case 17 and dividing the filter room 16 into an upstream dust chamber 16*a* and a downstream clean chamber 16*b*. The air cleaner case 17 is constituted of a case main body 17*a* retaining the air filter 18 and a cover member 17*b* detachably attached to the case main body 17*a*. The detachable attachment of the cover member 17*b* enables maintenance of the air filter 18. Formed in a side face of the case main body 17*a* is an opening serving as an inlet for the intake air, and this opening constitutes the upstream end 11*a* of the air intake passage 11. The air cleaner 12 purifies the air taken in through the intake air inlet by having the air pass through the air filter 18, and sends the purified air to the gas mixer 13.

The fuel supply passage 14 is provided with a proportional valve unit 21. The proportional valve unit 21 includes a solenoid valve 22 and a proportional valve 23 disposed downstream of the solenoid valve 22. The solenoid valve 22 is normally closed on-off valve, and is driven to open by electric power supplied from a power supply not shown in the drawing. The solenoid valve 22 is closed to prevent the fuel gas from being supplied to the engine main body 2 when the internal combustion engine 1 is stopped, and is opened to feed the fuel gas to the engine main body 2 when the internal combustion engine 1 is in operation. The proportional valve 23 is a solenoid proportional valve that controls the supply pressure of the fuel gas in accordance with an amount of energizing current without depending on the pressure of the fuel gas supplied thereto, to thereby control the flow rate of the fuel gas passing through the fuel supply passage 14. As the proportional valve 23 can keep the supply pressure of the fuel gas substantially constant, it is possible to omit a conventional pressure regulator and achieve a compact device. It is to be noted that the proportional valve 23 may have a known structure as that disclosed in JP H08-42400A, for example, and therefore, detailed description thereof is omitted here.

The gas mixer 13 includes a gas nozzle (not shown in the drawings) provided at the downstream end 14*b* of the fuel supply passage 14, a throttle valve (not shown in the drawings) and a throttle motor 24 for driving the throttle valve to open and close, and mixes the fuel gas ejected from the gas nozzle in an amount corresponding to the intake negative pressure into the intake air to generate gas mixture. The generated gas mixture is sent to the combustion chamber 2*a* of the engine main body 2 via the air intake passage 11.

The cylinder head 6 is provided with an ignition plug (not shown in the drawings) such that the electrode of the ignition plug is placed in the combustion chamber 2*a*. With electric power being supplied from a power supply (not shown in the drawing) via an ignition device including an ignition coil, the ignition plug produces a spark discharge at predetermined timings to ignite the gas mixture and burn the fuel gas.

The exhaust system 4 includes an exhaust passage 26 that guides the burned gas generated in the combustion chamber 2*a* to the atmosphere. The exhaust passage 26 is provided with a muffler 27.

When the fuel gas is burned, the gas with a high pressure in the combustion chamber 2*a* leaks through the gap between the piston and the circumferential wall surface of the cylinder 8*a* to the crank chamber 9*a*. The blow-by gas that has leaked to the crank chamber 9*a* contains unburned air-fuel mixture and oil, and if released without any treatment, would cause air pollution. For this reason, the internal combustion engine 1 is provided with a breather device 30 for recirculating the blow-by gas generated in the crank chamber 9*a* to the air intake passage 11 by use of the pressure in the crank chamber 9*a* and the negative pressure in the intake system 3.

The breather device 30 includes, from upstream to downstream, a breather chamber 31 communicating with the crank chamber 9*a*, a filter device 33 communicating with the breather chamber 31 and equipped with a filter chamber 32, and a breather passage 34 communicating the filter chamber 32 and the intake system 3 with each other.

The breather chamber 31 separates oil from the blow-by gas flowing therein from the crank chamber 9*a*, and is defined by a wall 50 (also referred to as a "first wall") integral with the crankcase 9 such that the breather chamber 31 is adjacent to the crank chamber 9*a*.

Figure 2:
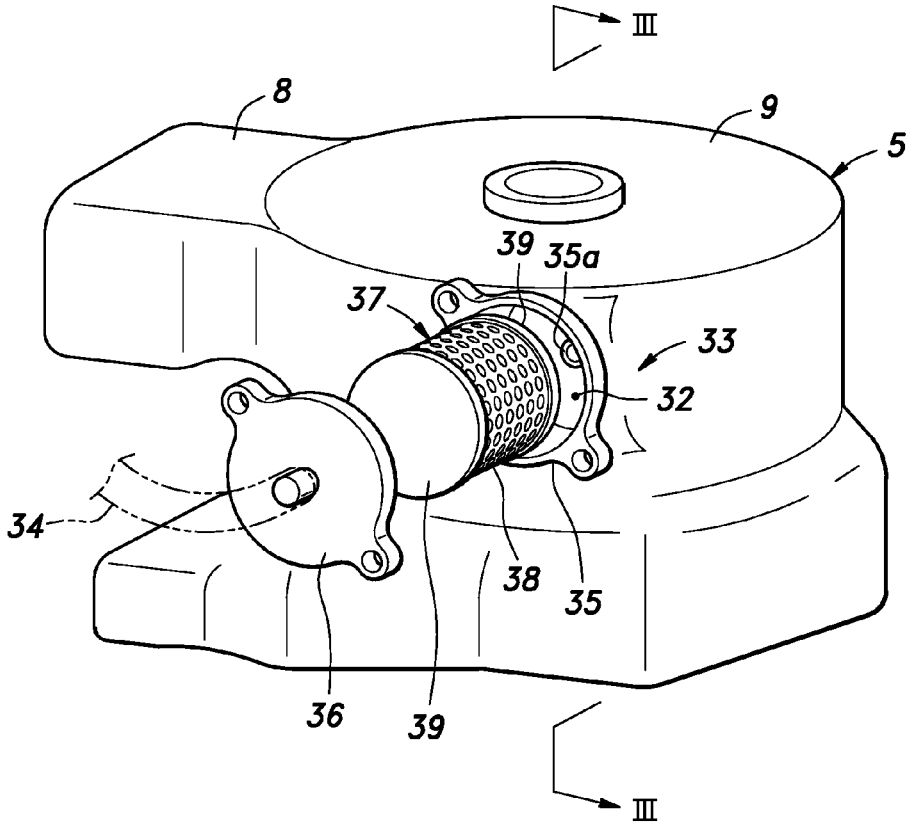
FIG. 2 is a fragmentary perspective view of the internal combustion engine shown in FIG. 1, in which the filter device is shown in an exploded state.

As also shown in FIG. 2, the filter device 33 includes a filter housing 35 that is formed integrally with the crankcase 9 and defines the filter chamber 32 at a position adjacent to the crank chamber 9*a* such that the filter chamber 32 has a cylindrical shape and opens out laterally, a filter cover 36 detachably attached to the opening of the filter housing 35 to tightly close the filter chamber 32, and a filter 37 accommodated in the filter chamber 32. The filter device 33 is configured such that the blow-by gas entering from the breather chamber 31 passes through the filter 37 so that oil is further separated from the blow-by gas by the filter 37. The detachable attachment of the filter cover 36 to the filter housing 35 enables maintenance of the filter 37.

The breather passage 34 is formed of a pipe connected to the filter cover 36 and the air cleaner case 17, and guides the blow-by gas that has passed through the filter device 33 to the air cleaner 12. The downstream end of the breather passage 34 is connected to the dust chamber 16*a* of the air cleaner 12.

Figure 3:
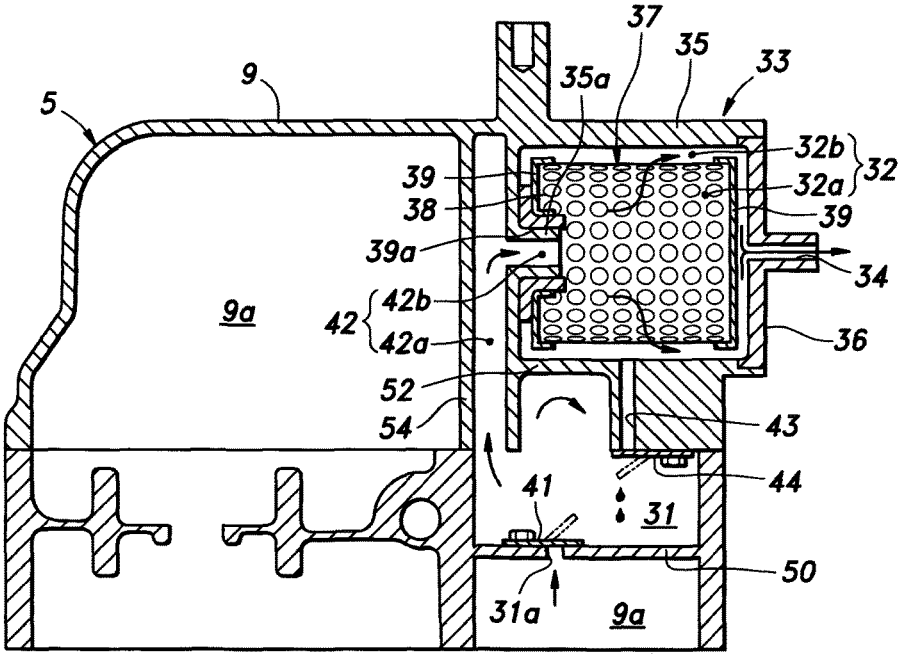
FIG. 3 is a cross-sectional view taken along line III-III in FIG. 2.

FIG. 3 is a cross-sectional view taken along line III-III in FIG. 2. As shown in FIGS. 2 and 3, the filter housing 35 is provided such that the filter chamber 32 is positioned above the breather chamber 31 and adjacent to the crank chamber 9*a* and the breather chamber 31. Specifically, the filter housing 35 and a wall 52 (also referred to as a "second wall") defining the breather chamber 31 are both formed integrally with the crankcase 9, and a lower part of the filter housing 35 constitutes an upper part of the second wall 52 defining the breather chamber 31. A cylindrical mounting boss 35*a* for mounting the filter is formed to protrude from a bottom wall surface of the filter housing 35 facing the filter cover 36.

The filter 37 includes a cylindrical filter plate 38 having many openings (passages of the blow-by gas) formed therein by small punching holes, and end plates 39, 39 secured to either axial end of the filter plate 38. At the center of one end plate 39 is formed a mounting hole 39*a*, such that by fitting the mounting hole 39*a* onto the mounting boss 35*a*, the filter 37 is detachably attached to the filter housing 35 (crankcase 9). The filter chamber 32 is divided by the filter 37 into an upstream space 32*a* (interior space of the filter plate 38) communicating with the breather chamber 31 and a downstream space 32*b* communicating with the breather passage 34.

A gas inlet 31*a* is formed at the substantially central part of the first wall 50, or the bottom wall of the breather chamber 31, and a first reed valve 41 is provided on the upper surface of the first wall 50 so as to close the gas inlet 31*a*. The first reed valve 41 is a one-way valve that allows the blow-by gas to flow from the crank chamber 9*a* to the breather chamber 31 but prevents the blow-by gas from flowing from the breather chamber 31 to the crank chamber 9*a*. The first reed valve 41 is mounted in such an orientation that when opened, the first reed valve 41 allows the blow-by gas to flow into the breather chamber 31 toward an outer part of the breather chamber 31 away from the crank chamber 9*a*.

The breather chamber 31 and the upstream space 32*a* of the filter chamber 32 are connected with each other by a communication passage 42 formed on a side of the crank chamber 9*a* and separated from the crank chamber 9*a* by a third wall 54. The lower end of the communication passage 42 is connected with a crankshaft-side end portion (left end portion in FIG. 3) of the breather chamber 31. The communication passage 42 includes a vertical portion 42*a* extending upward from the lower end thereof and a branch portion 42*b* extending laterally from an intermediate part of the vertical portion 42*a* to form a cylindrical hole in the mounting boss 35*a*.

Further, the breather chamber 31 and the downstream space 32*b* of the filter chamber 32 are connected with each other by an oil return passage 43. The oil return passage 43 extends downward from the lowermost part of the filter chamber 32 through a lower wall of the housing 35 and opens out in the breather chamber 31 at a lower end thereof. A second reed valve 44 is provided on the upper wall of the breather chamber 31 so as to close the outlet (lower end) of the oil return passage 43. The second reed valve 44 is a one-way valve that allows the oil to flow from the filter chamber 32 to the breather chamber 31 but prevents the blow-by gas from flowing from the breather chamber 31 to the filter chamber 32. The second reed valve 44 may be configured to open by the pressure of the oil accumulated in the oil return passage 43, or may be configured to open only when the crank chamber 9*a* has a negative pressure as a result of pressure pulsation.

Now, a description will be made of the operation and effect of the breather device 30 configured as described in the foregoing.

First, the flow of the blow-by gas and oil will be described. Because the communication passage 42 is connected to a part of the breather chamber 31 that is not in the direction of flow of the blow-by gas entering the breather chamber 31 (rightward in FIG. 3), the blow-by gas (containing oil) that has entered the breather chamber 31 flows inside the breather chamber 31 such that the oil contained therein impinges on the second wall 52 defining the breather chamber, whereby the oil adheres to the second wall 52 and is separated from the blow-by gas. Further, because the communication passage 42 is bent at the connection between the vertical portion 42*a* and the branch portion 42*b*, oil is further separated from the blow-by gas while the blow-by gas flows through the communication passage 42.

The blow-by gas that has entered the upstream space 32*a* of the filter chamber 32 from the communication passage 42 moves to the downstream space 32*b* through the openings of the filter plate 38. In this process, the oil contained in the blow-by gas adheres to the filter plate 38 and flows downward due to the force of gravity. The oil accumulated in the lowermost part of the filter chamber 32 is returned to the breather chamber 31 through the oil return passage 43, and further flows back to the crank chamber 9*a* through a passage (not shown in the drawing) communicating the breather chamber 31 with the crank chamber 9*a*, such that the oil is eventually collected in the oil pan 10 (FIG. 1).

As described above, the breather device 30 of the illustrated embodiment is provided with: a breather chamber 31 formed adjacent to the crank chamber 9*a* such that the breather chamber 31 communicates with the crank chamber 9*a* and separates oil from the blow-by gas flowing therein from the crank chamber 9*a*; a filter chamber 32 formed adjacent to the crank chamber 9*a* such that the filter chamber 32 communicates with the breather chamber 31 and accommodates the filter 37 for separating oil from the blow-by gas that flows in the filter chamber 32 from the breather chamber 31; and a breather passage 34 that communicates the filter chamber 32 and the intake system 3 with each other. In such an arrangement, the oil in the blow-by gas is separated at the breather chamber 31, and thereafter, is further separated by the filter 37, whereby the oil is effectively separated from the blow-by gas. Further, because the breather chamber 31 and the filter chamber 32 are each formed adjacent to the crank chamber 9*a*, they are easily warmed by the heat from the crank chamber 9*a*. Thereby, a decrease in the temperature of the blow-by gas flowing through these chambers and the oil contained in the blow-by gas is suppressed, and hence, clogging of the openings of the filter 37 by the oil is prevented. Thus, even in a cold state operation, oil is separated from the blow-by gas effectively, and the clean blow-by gas, from which the oil has been separated, is provided to the intake system 3.

Further, in the illustrated embodiment, the intake system 3 includes the air cleaner 12 having the dust chamber 16*a* and the clean chamber 16*b* separated by the air filter 18, and the breather passage 34 is connected to the dust chamber 16*a* of the air cleaner 12. The connection of the breather passage 34 to the dust chamber 16*a* is possible because the breather device 30 of the present embodiment effectively separates oil from the blow-by gas as described above. Due to this arrangement, because the blow-by gas is supplied to the internal combustion engine 1 after passing through the air filter 18, the oil that could not be separated from the blow-by gas by the filter 37 is separated by the air filter 18, and therefore, cleaner blow-by gas is supplied to the internal combustion engine 1.

Yet further, because the filter chamber 32 is disposed at a position higher than that of the breather chamber 31 and thus can be warmed easily, absorption of heat from the blow-by gas and oil by the filter 37 is suppressed, and clogging of the openings of the filter 37 is prevented even more effectively.

In addition, the breather device 30 of the present embodiment includes the oil return passage 43 communicating the filter chamber 32 and the breather chamber 31 with each other and the second reed valve 44 provided to the oil return passage 43 to enable only the flow of the fluid from the filter chamber 32 to the breather chamber 31. Thereby, the oil separated by the filter chamber 32 disposed at an upper position is returned easily to the breather chamber 31 disposed at a lower position through the oil return passage 43 owing to the force of gravity. Further, because the oil return passage 43 is equipped with the second reed valve 44, the oil is returned to the breather chamber 31 smoothly, without a reverse flow of the oil through the oil return passage 43 to the filter chamber 32 which otherwise could occur due to pressure pulsation in the crank chamber 9*a*.

In the present embodiment, the internal combustion engine 1 and the breather device 30 are disposed in the cogeneration case 101 and constitute the cogeneration unit 100. In comparison to the case where the internal combustion engine 1 is used as a power source for a vehicle or an outdoor work machine, the internal combustion engine 1 used in the cogeneration unit 100 is required to have a higher emission reduction performance. As the above-described breather device 30 can separate the oil in the blow-by gas effectively and thereby reduce the pollutants in the exhaust gas, the breather device 30 can be preferably used in the cogeneration unit 100 as illustrated.

In the foregoing, the present invention has been described in terms of the concrete embodiment thereof, but the present invention is not limited to the foregoing embodiment and various alterations and modifications may be made. For example, in the above embodiment, the first wall 50 defining the breather chamber 31 and the filter housing 35 defining the filter chamber 32 are formed integrally with the crankcase 9, but they may be formed as separate members and mounted to the crankcase 9. In such a case, it is preferred if the filter housing 35, etc. are attached to the crankcase 9 in such a manner that they are in close contact with the crankcase 9 with a large contact area, so that they can exchange heat with the crankcase 9 effectively. Further, in the above embodiment, the openings of the filter 37 are realized by punching holes formed in the filter plate 38, but the filter 37 may include a mesh or the like instead of the filter plate 38.

Figure 4:
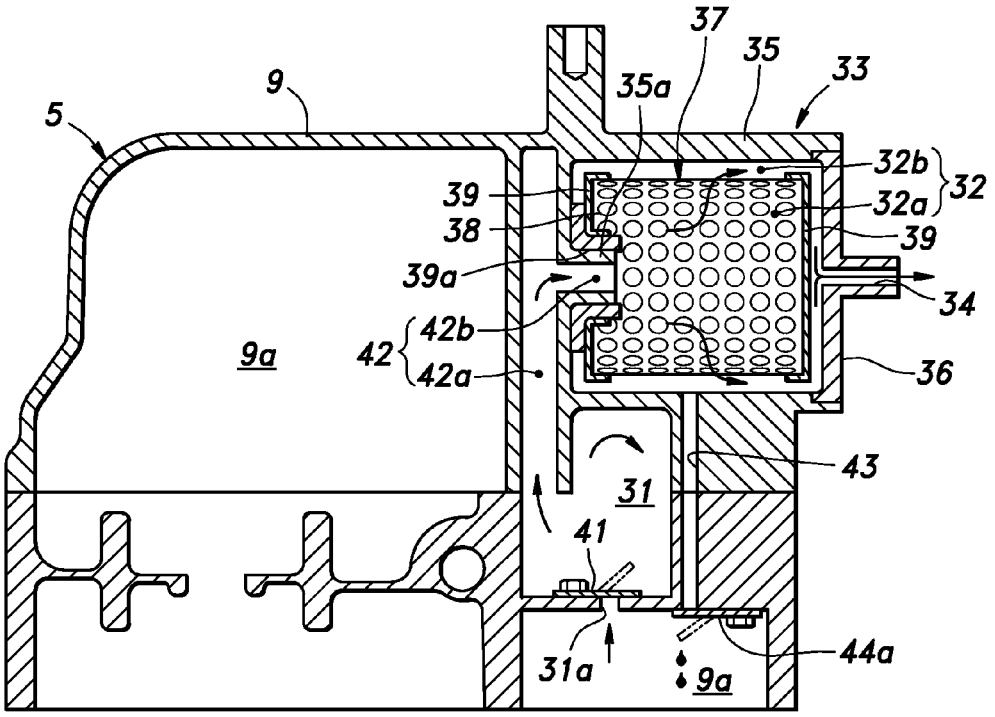
FIG. 4 is a cross-sectional view similar to FIG. 3 and showing a modified embodiment.

Further, though in the above embodiment, the filter chamber 32 was connected to the crank chamber 9*a* via the breather chamber 31 to allow the oil separated in the filter chamber 32 to return to the crank chamber 9*a*, the filter chamber 32 may be directly connected with the crank chamber 9*a* for the same purpose, as shown in FIG. 4, in which component parts similar to those shown in FIG. 3 are denoted by same reference signs. In the embodiment shown in FIG. 4, the oil return passage 43 extends downward from the lowermost part of the filter chamber 32 to the crank chamber 9*a* through the lower wall of the housing 35 and a wall defining a lower part of the breather chamber to directly connect the filter chamber 32 with the crank chamber 9*a*. Further, a reed valve 44*a* is provided on the upper wall of the crank chamber 9*a* so as to close the outlet (lower end) of the oil return passage 43. This reed valve 44*a* operates similarly to the second reed valve 44 shown in FIG. 3; namely, allows the oil to flow from the filter chamber 32 to the crank chamber 9*a* but prevents the blow-by gas from flowing from the crank chamber 9*a* to the filter chamber 32.

In addition, the concrete structure, arrangement, number, angle, material, etc. of the members or parts of the embodiments may be appropriately changed within the scope of the sprit of the present invention. Also, not all of the structural elements shown in the above embodiments are necessarily indispensable and they may be selectively used as appropriate.

The invention claimed is:

1. A breather device for an internal combustion engine for guiding blow-by gas generated in a crank chamber to an intake system, the breather device comprising:

a breather chamber formed adjacent to the crank chamber such that the breather chamber communicates with the crank chamber, wherein the breather chamber is separated from the crank chamber by a first wall and communicates with the crank chamber via a gas inlet formed in the first wall separating the breather chamber from the crank chamber, the breather chamber being configured to separate oil from the blow-by gas that flows in the breather chamber from the crank chamber;

a filter chamber formed adjacent to the crank chamber such that the filter chamber communicates with the breather chamber, the filter chamber accommodating a filter for separating oil from the blow-by gas that flows in the filter chamber from the breather chamber; and a breather passage that communicates the filter chamber and the intake system with each other, wherein a second wall defining a part of the breather chamber and a filter housing defining the filter chamber are both formed integrally with a crankcase defining the crank chamber, and wherein the breather chamber and the filter chamber are connected to each other by a communication passage separated from the crank chamber by a third wall constituting a part of the crankcase.

2. The breather device for the internal combustion engine according to claim 1, wherein the intake system includes an air cleaner having a dust chamber and a clean chamber separated by an air filter, and the breather passage is connected to the dust chamber of the air cleaner.

3. The breather device for the internal combustion engine according to claim 1, wherein the filter chamber is disposed at a position higher than that of the breather chamber.

4. The breather device for the internal combustion engine according to claim 3, further comprising:

an oil return passage communicating the filter chamber and the breather chamber with each other; and a one-way valve that is provided to the oil return passage and enables only a flow of a fluid from the filter chamber to the breather chamber.

5. The breather device for the internal combustion engine according to claim 3, further comprising:

an oil return passage communicating the filter chamber and the crank chamber with each other; and a one-way valve that is provided to the oil return passage and enables only a flow of a fluid from the filter chamber to the crank chamber.

6. The breather device for the internal combustion engine according to claim 1, wherein the breather device is disposed in a housing of a cogeneration unit.

7. The breather device for the internal combustion engine according to claim 1, wherein the communication passage is defined on a side of the crank chamber relative to the breather chamber and the filter chamber, and includes a first portion extending from the breather chamber along the crank chamber and a second portion extending from the first portion to the filter chamber.

8. The breather device for the internal combustion engine according to claim 7, wherein a cylindrical mounting boss for mounting the filter is formed in a wall of the filter housing on a side of the crank chamber, and the second portion of the communication passage is defined in the mounting boss.

9. A breather device for an internal combustion engine for guiding blow-by gas generated in a crank chamber to an intake system, the breather device comprising:

a breather chamber formed adjacent to the crank chamber such that the breather chamber communicates with the crank chamber, wherein the breather chamber is separated from the crank chamber by a first wall and communicates with the crank chamber via a gas inlet formed in the first wall separating the breather chamber from the crank chamber, the breather chamber being configured to separate oil from the blow-by gas that flows in the breather chamber from the crank chamber;

a filter chamber formed adjacent to the crank chamber such that the filter chamber communicates with the breather chamber, the filter chamber accommodating a filter for separating oil from the blow-by gas that flows in the filter chamber from the breather chamber; and a breather passage that communicates the filter chamber and the intake system with each other, wherein a second wall defining a part of the breather chamber and a filter housing defining the filter chamber are both formed integrally with a crankcase defining the crank chamber, wherein the breather chamber and the filter chamber are connected to each other by a communication passage separated from the crank chamber by a third wall constituting a part of the crankcase, and wherein the gas inlet formed in the first wall separating the breather chamber from the crank chamber is closed by a one-way valve that allows the blow-by gas to flow from the crank chamber to the breather chamber.

10. The breather device for the internal combustion engine according to claim 9, wherein the intake system includes an air cleaner having a dust chamber and a clean chamber separated by an air filter, and the breather passage is connected to the dust chamber of the air cleaner.

11. The breather device for the internal combustion engine according to claim 9, wherein the filter chamber is disposed at a position higher than that of the breather chamber.

12. The breather device for the internal combustion engine according to claim 11, further comprising:

an oil return passage communicating the filter chamber and the breather chamber with each other; and a one-way valve that is provided to the oil return passage and enables only a flow of a fluid from the filter chamber to the breather chamber.

13. The breather device for the internal combustion engine according to claim 11, further comprising:

an oil return passage communicating the filter chamber and the crank chamber with each other; and a one-way valve that is provided to the oil return passage and enables only a flow of a fluid from the filter chamber to the crank chamber.

14. The breather device for the internal combustion engine according to claim 9, wherein the breather device is disposed in a housing of a cogeneration unit.

15. The breather device for the internal combustion engine according to claim 9, wherein the communication passage is defined on a side of the crank chamber relative to the breather chamber and the filter chamber, and includes a first portion extending from the breather chamber along the crank chamber and a second portion extending from the first portion to the filter chamber.

16. The breather device for the internal combustion engine according to claim 15, wherein a cylindrical mounting boss for mounting the filter is formed in a wall of the filter housing on a side of the crank chamber, and the second portion of the communication passage is defined in the mounting boss.

* * * * *